US007628231B2

(12) United States Patent
Lin

(10) Patent No.: US 7,628,231 B2
(45) Date of Patent: Dec. 8, 2009

(54) PROTECTOR FOR ROCK BIT SEALS

(75) Inventor: Chih C. Lin, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 313 days.

(21) Appl. No.: 11/524,819

(22) Filed: Sep. 21, 2006

(65) Prior Publication Data

US 2008/0073124 A1 Mar. 27, 2008

(51) Int. Cl.
*E21B 10/25* (2006.01)

(52) U.S. Cl. ..... 175/371; 277/355

(58) Field of Classification Search ..... 175/371, 175/372; 277/355, 549

See application file for complete search history.

(56) References Cited

U.S. PATENT DOCUMENTS 3,921,735 A 11/1975 Dysart
4,610,319 A * 9/1986 Kalsi ..... 175/371
4,688,651 A 8/1987 Dysart
4,696,480 A 9/1987 Jornhagen
4,790,396 A * 12/1988 Fuller ..... 175/249
4,981,182 A 1/1991 Dysart
5,509,670 A * 4/1996 Wheeler ..... 277/565
6,123,337 A 9/2000 Fang et al.
6,170,830 B1 1/2001 Cawthorne et al.
6,179,296 B1 1/2001 Cawthorne et al.
6,196,339 B1 3/2001 Portwood et al.
6,598,690 B2 * 7/2003 Peterson ..... 175/371
6,679,500 B1 1/2004 Maurer et al.

FOREIGN PATENT DOCUMENTS

GB 2387192 A 10/2003

OTHER PUBLICATIONS

Perkin Elmer, Inc., Fluid Sciences, Brush Seals, copyright 1998-2004, one sheet.

* cited by examiner

*Primary Examiner*—Kenneth Thompson
(74) *Attorney, Agent, or Firm*—Bracewell & Giuliani LLP

(57) ABSTRACT

An earth-boring bit has a bit body with a depending bearing pin and a cone rotatably mounted thereon. A seal seals between the bearing pin and the cone. An annular set of bristles is located adjacent at least part of the dynamic seal surface of the seal to protect the seal against debris.

18 Claims, 2 Drawing Sheets

Fig. 1
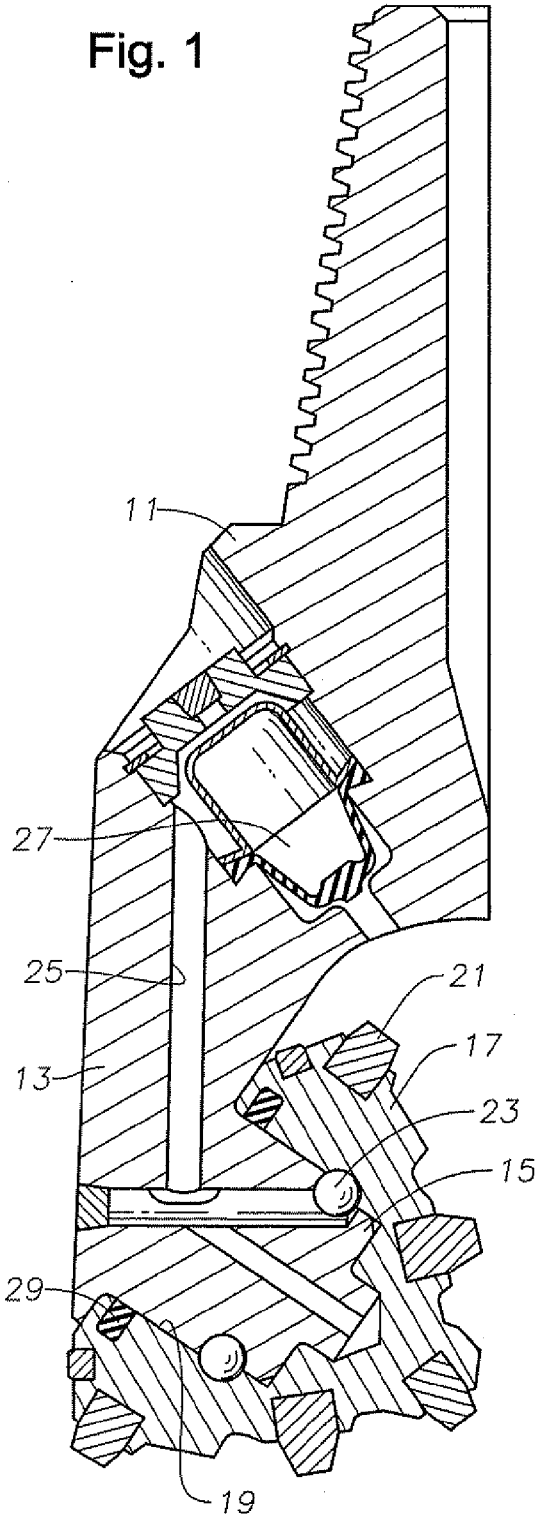
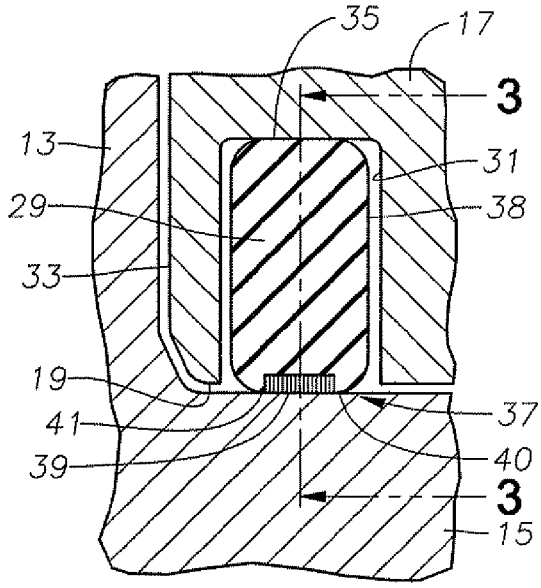
Fig. 2
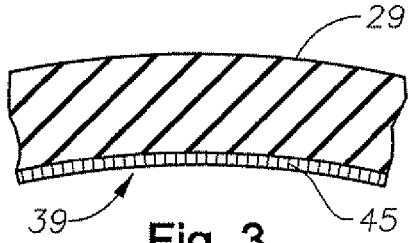
Fig. 3
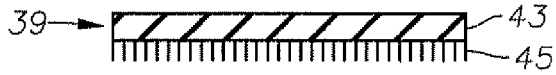
Fig. 4

PROTECTOR FOR ROCK BIT SEALS

FIELD OF THE INVENTION

This invention relates in general to earth-boring rotary cone drill bits and in particular to a protective device for protecting the seal for each cone from damage due to debris.

BACKGROUND OF THE INVENTION

An earth-boring bit of the type concerned herein has a bit body with at least one bearing pin, normally three, and a cone rotatably mounted to each bearing pin. Each cone has cutting elements for disintegrating the earth formation as the bit body rotates. The bearing spaces between the cavity of the cone and the bearing pin are filled with a lubricant. A seal is located near the mouth of the cone cavity for sealing lubricant from drilling fluid.

In drilling service, debris, whether it originates from the bearing or the bore hole, might find its way to the seal and cause wear. One type of seal comprises an elastomeric member with an inner diameter in sliding engagement with the bearing pin and an outer diameter that is normally in static engagement with the cone. This type of seal forms a nip area with the bearing pin and invites debris to accumulate near and migrate into the sealing interface. The accumulated debris causes wear and leakage.

Another type of seal employs primary metal-to-metal face seals energized by an elastomeric ring. One type of seal assembly employs a secondary elastomeric seal exterior of the energizer ring to protect the primary seal. The secondary seal takes up precious space, and the assembly requires pressure compensation for the space between the two seals.

Other designs use an elastomeric ring that has a more wear-resistant elastomeric layer upon the inner diameter. The more wear-resistant layer may comprise a different elastomer, or it may be made up of a wear-resistant fabric.

SUMMARY OF THE INVENTION

In this invention, a seal protector having a porous interface is mounted with the porous interface in sliding engagement with one of the annular surfaces of the seal area for protecting the primary seal. Preferably, the protector comprises a brush or a set of bristles that can repel or trap debris but does not seal.

The brush can be bonded or molded to the seal. In one embodiment, the exposed surface of the brush is initially recessed from the inner diameter of the seal by an amount determined by the intended squeeze of the seal once installed. When the seal is deformed between the bearing pin and seal groove base, the exposed surface of the brush is flush with the inner diameter of the seal.

In another embodiment, the exposed surface of the brush is flush with the inner diameter of the seal when the seal is in its natural undeformed condition. When the seal is deformed between the bearing pin and seal groove base, the bristles of the brush deflect against the bearing pin.

In still another embodiment, the inner diameter of the seal on the lubricant side of the seal is smaller than on the drilling fluid side. The brush is bonded to the inner diameter of the seal on the drilling fluid side, thus is initially recessed. When the seal is deformed between the seal groove and the bearing pin, the brush comes into substantial contact with the bearing pin.

In a fourth embodiment, the brush is mounted to the cavity of the cone on the drilling fluid side of the seal groove. A flat spacer washer may be located in the seal groove between the seal and the brush to support and stabilize the brush.

BRIEF DESCRIPTION OF THE DRAWINGS

FIG. 1 is a partial sectional view of an earth-boring bit having a seal in accordance with this invention.

FIG. 2 is an enlarged sectional view of the seal assembly and a portion of the drill bit of FIG. 1.

FIG. 3 is a partial sectional view of the seal assembly of FIG. 2, taken along the line 3-3 of FIG. 2.

FIG. 4 is an enlarged transverse sectional view of the set of bristles or brush mounted in the seal of FIG. 2, and shown apart from the seal.

DETAILED DESCRIPTION OF THE EMBODIMENT

Figure 5:
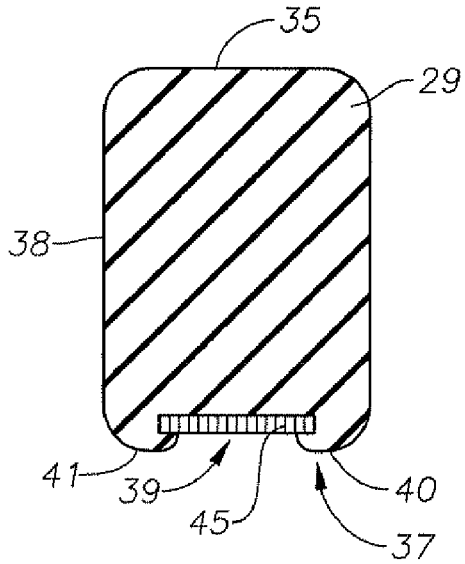
FIG. 5 is a sectional view of the seal assembly shown in FIG. 2, and shown in a natural, undeformed condition.

Referring to FIG. 1, the bit has a bit body 11 with at least one bit leg 13, and preferably three. A bearing pin 15 depends downward and forward from each bit leg 13 toward the bit axis of rotation. A cone 17 has a cavity 19 that slides over bearing pin 15, allowing cone 17 to rotate relative to bearing pin 15. Cone 17 has a plurality of cutting elements 21 on its exterior. Cutting elements 21 may be tungsten carbide inserts pressed into mating holes, or cutting elements 21 may comprise teeth integrally machined from the body of cone 17. Cone 17 is held on bearing pin 15 by a locking element, which in this embodiment comprises a plurality of balls 23 located in mating annular grooves of bearing pin 15 in cone cavity 19.

A lubricant passage 25 extends through each bit leg 13 from a compensator 27 to the bearing spaces within cavity 19. A seal 29 seals lubricant within the bearing spaces. Compensator 27 reduces the pressure differential across seal 29, which is exposed to borehole pressure on its rearward side and lubricant pressure on its forward side.

Referring to FIG. 2, seal 29 is preferably located within a seal groove 31 formed in cone cavity 19. Seal groove 31 has a cylindrical base and parallel flat side walls that are perpendicular to the axis of bearing pin 15. Seal groove 31 is located a short distance within cavity 19. Cone 17 has a back face 33 that surrounds the mouth of cavity 19.

Seal 29 comprises an elastomeric ring having an outer diameter 35 and an inner diameter 37. Preferably, outer diameter 35 and inner diameter 37 are generally cylindrical, and preferably the forward and rearward side surfaces 38 of seal 29 are generally flat. Other shapes are feasible for seal 29.

In this embodiment, a seal protector 39 is mounted to seal inner diameter 37 for rotation therewith. Seal protector 39 is a flexible annular member that has an axial width that is less than the axial width of seal inner diameter 37 from one seal side surface 38 to the other. In this embodiment only one protector 39 is shown, although more than one could be mounted to seal inner diameter 37. Unlike seal 19, seal protector 39 does not seal to the dynamic seal area formed on bearing pin 15. Rather, it comprises a porous surface to allow migration of fluid but to trap, repel or block debris. The inner diameter of seal protector 39 is preferably substantially the same as the outer diameter of bearing pin 15 once installed.

In the embodiment of FIG. 2, inner diameter 37 of seal 29 has a lubricant side dynamic seal surface 40 on one side of protector 39 and a drilling fluid side dynamic seal surface 41 on the opposite side of protector 39. Seal surfaces 40, 41 sealingly engage bearing pin 15 in sliding contact. Seal protector 39 protects drilling fluid side seal surface 41 from any debris that migrates past seal surface 40 and is generated internally within the bearing surfaces. Seal protector 39 protects lubricant side seal surface 40 from any debris in the drilling fluid that migrates past seal surface 41.

Seal protector 39 preferably comprises a brush member having a set of bristles 45, shown schematically in FIG. 4. Bristles 45 comprise individual parallel straight fibers or wires closely spaced to each other, similar to a brush. Bristles 45 may be bonded to a thin backing or substrate 43, which in turn is bonded or molded to inner diameter 37 of seal 29. Preferably there is no elastomeric material between the individual bristles 45, rather the bristles protrude from substrate 43 and the spaces between the individual bristles 45 are open.

In the embodiment of FIGS. 1-5, the height of each bristle 45 is much smaller than the distance from seal inner diameter 37 to seal outer diameter 35, although the height could be much greater, such as up to 80% of the height of seal 29. The forward and rearward side edges of seal protector 39 are shown to be straight and in planes perpendicular to the axis of bearing pin 15. Alternately, the forward and rearward side edges of seal protector 39 could be wavy in a sinuous fashion with portions being located further rearward toward back face 33 than other portions. The density of bristles 45 depends upon the depth of the well being drilled. The deeper the well being drilled, the denser bristles 45 should be to increase stiffness. Bristles 45 can be made of a variety of materials, including metals such as nickel alloy, stainless steel, brass, bronze, or carbon steel; synthetics such as nylon, polyester, or propylene; and natural fillings such as horsehair. Rather than having bristles, seal protector 39 might comprise a sponge-like member, or a member having reticulated fibers, similar to a dishwashing scouring pad.

Referring to FIG. 5, when seal 29 is in its natural, undeformed condition, dynamic seal surfaces 40, 41 protrude inward from the exposed ends of bristles 45. When seal 29 is installed within a drill bit, as shown in FIG. 2, seal 29 is squeezed, with its outer diameter 35 forming a static seal with the base of groove 31 and inner diameter dynamic seal surfaces 40, 41 deformed against bearing pin 15. When seal 29 is deformed, dynamic seal surfaces 40, 41 will flatten, as shown in FIG. 2. The exposed ends of bristles 45 will be touching or nearly touching the seal area on bearing pin 15.

During the operation of the embodiment of FIGS. 1-5, initially, lubricant will be sealed by dynamic seal surface 40 and outer diameter 35. Drilling fluid is sealed by dynamic seal surface 41 and outer diameter 35. When the bit is rotated, cone 17 rotates, and seal 29 will normally rotate with cone 17. Seal surfaces 40, 41 slightly engage bearing pin 15 during rotation.

Drilling fluid debris tends to enter the clearance between bit leg 13 and back face 33, and this debris can become trapped in the nip area of dynamic seal surface 41. The debris causes wear of dynamic seal 41, and some of the debris may migrate forward past dynamic seal surface 41. Protector 39 will tend to repel or trap the debris, preventing it from entering the nip area of dynamic seal surface 40. Similarly, some debris may be generated internally within the bearing spaces, and some of this debris may migrate rearward past dynamic seal surface 40. Protector 39 tends to repel or trap this debris, preventing it from entering the nip area of dynamic seal surface 41.

Figure 6:
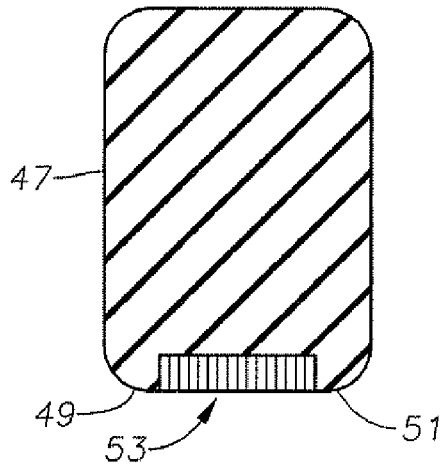
FIG. 6 is a sectional view of an alternate embodiment of the seal assembly of FIG. 2, and shown in a relaxed condition.

In the embodiment of FIG. 6, seal 47 has dynamic seal surfaces 49, 51 on its inner diameter on the forward and rearward sides of a brush or set of bristles 53. Bristles 53 may be generally the same as bristles 45 of the first embodiment. In this embodiment, in its natural position prior to installation, the inner diameters of bristles 53 are flush with the inner diameters of dynamic seal surfaces 49, 51. When seal 47 is installed in a drill bit, bristles 53 will deflect or bend due to the deformation between the outer diameter of seal 47 and seal surfaces 49, 51. Bristles 53 will thus be urged into contact with the bearing pin 15 (FIG. 1) by the natural resiliency of seal 47.

Figure 7:
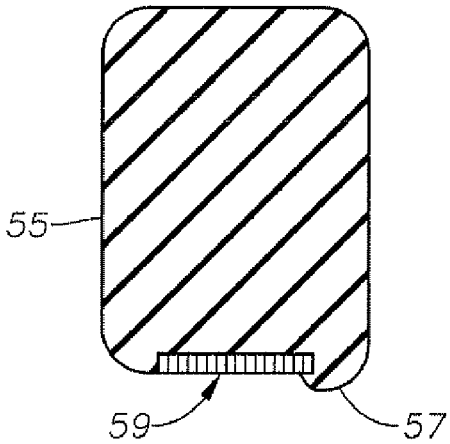
FIG. 7 is a sectional view of another alternate embodiment of the seal assembly of FIG. 2, and shown in a relaxed condition.

In the embodiment of FIG. 7, seal 55 is constructed in the same manner as seal 29 of FIG. 5, except that it has only one dynamic seal surface 57, not two. Dynamic seal surface 57 is located on the lubricant or forward side of seal 55. Bristles 59 join dynamic seal surface 57 on the drilling fluid side of dynamic seal surface 57. The inner diameter of dynamic seal surface 57 when undeformed is less than the inner diameter of the exposed ends of bristles 59. When installed in a drill bit, seal 55 will deform, causing seal surface 57 to flatten and bristles 59 to make substantial contact with or be closely spaced to bearing pin 15.

Figure 8:
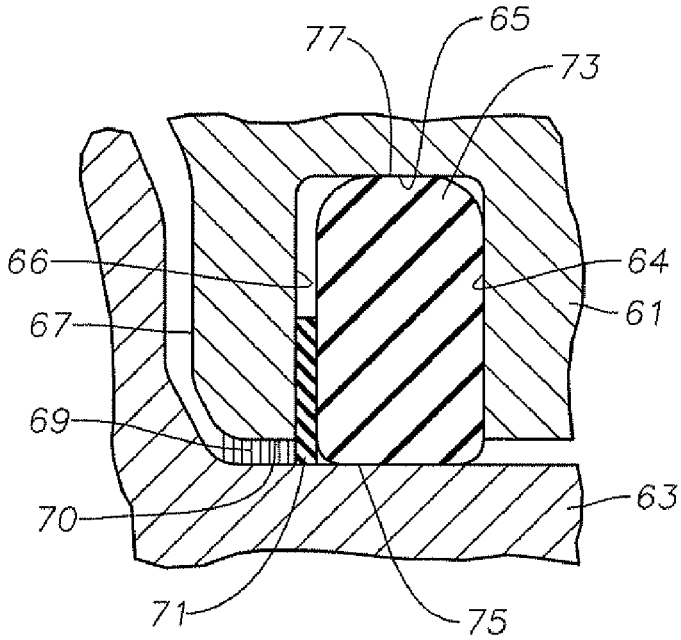
FIG. 8 is a sectional view of another alternate embodiment of the seal assembly of FIG. 2, and a portion of the drill bit of FIG. 1.

In the embodiment of FIG. 8, cone 61 and bearing pin 63 may be constructed the same as in the FIG. 1 embodiment. Seal groove 65 may be the same as groove 31 (FIG. 1), having a cylindrical base and parallel, flat side walls 64, 66. In this embodiment, bristles 69 are mounted directly to the cylindrical cavity 70 of cone 61 for rotation therewith, rather than to seal 73. Bristles 69 are located on the rearward or drilling fluid side of seal groove 65. Bristles 69 may be mounted by adhesive or otherwise to cone cavity 70 in the space between groove 65 and back face 67.

Also, in this embodiment, a spacer washer 71 may be located in groove 65. Spacer washer 71 is a flat disk sandwiched between seal 73 and groove side wall 66. The inner diameter of spacer washer 71 is substantially flush with the inner diameter of the set of bristles 69 for providing support to bristles 69. Spacer washer 71 is preferably adhesively bonded to groove side wall 66. Spacer washer 71 need not seal against bearing pin 63. Seal 73 may be conventional in this embodiment, having a dynamic seal surface 75 on its inner diameter and a static seal surface 77 on its outer diameter.

The invention has significant advantages. The protector provides protection against debris contact with elastomeric seal nip areas. The protector does not require any additional seal gland space. The additional protection provided by the protector prolongs the life of the seal and thus the life of the drill bit.

While the invention has been shown in only a few of its forms, it should be apparent to those skilled in the art that it is not so limited but is susceptible to various changes without departing from the scope of the invention. For example, although all of the embodiments show the protector mounted to a component that rotates relative to the bearing pin, alternately, the protector could be stationarily mounted to the bearing pin and in sliding contact with part of the cone.

I claim:

1. An earth boring bit, comprising:

a bit body having a depending bearing pin;

a cone having a plurality of cutting elements for engaging a bore hole, the cone having a cavity that rotatably engages the bearing pin, the cone and the bearing pin having a seal area defined by two annular surfaces, one of which rotates relative to the other;

a seal having a seal surface in sliding sealing engagement with one of the annular surfaces of the seal area, the seal surface having a lubricant side and a drilling fluid side, the seal surface serving as a primary barrier of the bit to prevent drilling fluid from encroaching into the cavity of the cone; and a debris protector in contact with the seal and having a porous surface substantially in sliding contact with one of the annular surfaces on the drilling fluid side of the seal surface.

2. The bit according to claim 1, wherein the porous surface comprises a set of bristles that extends completely around the bearing pin.

3. The bit according to claim 1, wherein the debris protector rotates with the cone.

4. The bit according to claim 1, wherein the debris protector is mounted to the seal.

5. An earth boring bit, comprising:

a bit body having a depending bearing pin;

a cone having a plurality of cutting elements for engaging a bore hole, the cone having a cavity that rotatably engages the bearing pin, the cone and the bearing pin having a seal area defined by two annular surfaces, one of which rotates relative to the other;

a seal in sealing engagement with the annular surfaces of the seal area;

a debris protector having a porous surface substantially in sliding contact with one of the annular surfaces; wherein:

the seal comprises an elastomeric ring having an inner diameter surface in sliding and sealing engagement with the bearing pin; and the debris protector is mounted to the seal and located on a drilling fluid side of at least part of the inner diameter surface and the porous surface extends completely around a circumference of the inner diameter surface.

6. The bit according to claim 5, wherein the inner diameter surface of the seal forms a primary barrier against drilling fluid flowing into the cavity of the cone.

7. The bit according to claim 5, wherein:

a first fully circumferential part of the inner diameter surface of the seal is located on a drilling fluid side of the debris protector and a second fully circumferential part of the inner diameter surface of the seal is located on a lubricant side of the debris protector.

8. The bit according to claim 7, wherein:

the first and the second fully circumferential parts of the inner diameter surface of the seal are in sliding and sealing engagement with the bearing pin.

9. An earth boring bit, comprising:

a bit body having a depending bearing pin;

a cone having a plurality of cutting elements for engaging a bore hole, the cone having a cavity that rotatably engages the bearing pin;

a seal between the bearing pin and the cone, the seal having at least one annular seal surface that slidingly and sealingly engages the bearing pin; and an annular brush located on a drilling fluid side of said at least one annular seal surface, the brush rotating relative to the bearing pin and having an inner diameter substantially equal to an outer diameter of the bearing pin.

10. The bit according to claim 9, wherein the brush is mounted to the seal for rotation therewith.

11. The bit according to claim 9, wherein:

the seal comprises an elastomeric ring having an inner diameter portion; and the brush is mounted to the inner diameter portion of the seal next to said at least one annular seal surface of the seal.

12. The bit according to claim 9, wherein:

the seal is located within a groove formed in and spaced from a mouth of the cavity; and the brush is mounted to the cone for rotation therewith between the groove and the mouth of the cavity.

13. The bit according to claim 9, wherein:

said at least one annular seal surface comprises two of the annular seal surfaces, each located within an inner diameter portion of the seal; and the brush is mounted in the inner diameter portion of the seal between the annular seal surfaces.

14. The bit according to claim 13, wherein:

when the seal is in a relaxed condition, the seal surfaces have inner diameters smaller than the inner diameter of the brush.

15. The bit according to claim 13, wherein:

when the seal is in a relaxed condition, the seal surfaces have inner diameters that are substantially the same as the inner diameter of the brush.

16. The bit according to claim 9, wherein:

said at least one annular seal surface comprises a single annular seal surface located within an inner diameter portion of the seal; and the brush is mounted to the inner diameter portion of the seal on a drilling fluid side of the annular seal surface.

17. A method of sealing drilling fluid from lubricant in an earth boring drill bit having a cone rotatably mounted on a bearing pin for engaging a borehole, comprising:

providing a seal area between the cone and the bearing pin defined by two annular surfaces, one of which rotates relative to the other, mounting a seal between the annular surfaces, the seal having at least one annular dynamic seal surface, and mounting a debris protector adjacent to a drilling fluid side of the dynamic seal surface;

rotating the cone on the bearing pin within a borehole and sealing drilling fluid in the borehole from contact with lubricant in the drill bit with the dynamic seal surface of the seal; and permitting any drilling fluid that contacts the debris protector to migrate past the debris protector into contact with the dynamic seal surface, but blocking with the debris protector at least some debris of the drilling fluid from reaching the dynamic seal surface.

18. The method according to claim 17, further comprising:

providing the seal with two of the annular dynamic seal surfaces and positioning the protector between the dynamic seal surfaces; and permitting any lubricant that leaks past one of the dynamic seal surfaces to migrate past the debris protector into contact with the other of the dynamic seal surfaces, but blocking with the debris protector at least some debris of the lubricant from reaching the other of the dynamic seal surfaces.

* * * * *